US009448015B2

(12) United States Patent
Seebald

(10) Patent No.: US 9,448,015 B2
(45) Date of Patent: Sep. 20, 2016

(54) HEAT TRANSFER ELEMENT FOR A ROTARY REGENERATIVE HEAT EXCHANGER

(71) Applicant: ALSTOM Technology Ltd, Baden (CH)

(72) Inventor: James David Seebald, Wellsville, NY (US)

(73) Assignee: ARVOS TECHNOLOGY LIMITED, Wellsville, NY (US)

( * ) Notice: Subject to any disclaimer, the term of this patent is extended or adjusted under 35 U.S.C. 154(b) by 271 days.

(21) Appl. No.: 14/096,428

(22) Filed: Dec. 4, 2013

(65) Prior Publication Data

US 2014/0090822 A1 Apr. 3, 2014

Related U.S. Application Data

(62) Division of application No. 12/543,648, filed on Aug. 19, 2009, now Pat. No. 8,622,115.

(51) Int. Cl.

| | |
|---|---|
| ***F23L 15/02*** | (2006.01) |
| ***F28F 5/00*** | (2006.01) |
| ***F28D 19/04*** | (2006.01) |
| ***F28F 3/04*** | (2006.01) |

(52) U.S. Cl.

CPC ..... *F28F 5/00* (2013.01); *F28D 19/044* (2013.01); *F28F 3/046* (2013.01); *Y10T 428/24686* (2015.01); *Y10T 428/24694* (2015.01); *Y10T 428/24702* (2015.01)

(58) Field of Classification Search

CPC ..... F28F 3/046; F28F 5/00; F28D 19/044; Y10T 428/24686; Y10T 428/24702; Y10T 428/24694

USPC ..... 165/6, 7, 8, 9, 10

See application file for complete search history.

(56) References Cited

U.S. PATENT DOCUMENTS

| | | | | |
|---|---|---|---|---|
| 1,875,188 | A | 8/1932 | Williams | |
| 1,915,742 | A | 6/1933 | Mautsch | |
| 1,987,798 | A | 1/1935 | Ruppricht | |
| 2,042,017 | A | 5/1936 | Orchard | |
| 2,102,936 | A | 12/1937 | Bailey | |
| 2,160,677 | A | 5/1939 | Romanoff | |
| 2,438,851 | A | 3/1948 | Gates | |
| 2,596,642 | A | 5/1952 | Boestad | |
| 2,782,009 | A | 2/1957 | Rippingille | |
| 2,796,157 | A | 6/1957 | Ginsburg | |
| 2,812,165 | A * | 11/1957 | Hammond | F28D 9/00 165/166 |
| 2,940,736 | A | 6/1960 | Odman | |
| 2,983,486 | A | 5/1961 | Rosenberg | |
| 3,158,527 | A | 11/1964 | Faccin et al. | |
| 3,183,963 | A | 5/1965 | Mondt | |
| 3,216,494 | A | 11/1965 | Goodman | |

(Continued)

FOREIGN PATENT DOCUMENTS

| | | |
|---|---|---|
| JP | 2001516866 A | 10/2001 |
| WO | 9914543 A1 | 3/1999 |
| WO | WO 99/14543 | 3/1999 |

*Primary Examiner* — Ljiljana Ciric

(74) *Attorney, Agent, or Firm* — MKG, LLC

(57) ABSTRACT

A rotary regenerative heat exchanger (1) employs heat transfer elements (100) shaped to include notches (150), which provide spacing between adjacent elements (100), and undulations (corrugations) (165,185) in the sections between the notches 150. The elements (100) described herein include undulations (165,185) that differ in height and/or width.

3 Claims, 4 Drawing Sheets

(56) References Cited

U.S. PATENT DOCUMENTS 3,260,511 A 7/1966 Greer
3,262,490 A 7/1966 Olson
3,372,743 A 3/1968 Pall et al.
3,373,798 A 3/1968 Brummett
3,523,058 A 8/1970 Shick
3,532,157 A 10/1970 Hubble
3,542,635 A 11/1970 Parker
3,574,103 A 4/1971 Latkin
3,674,620 A 7/1972 McCarthy et al.
3,726,408 A 4/1973 Gewiss
3,807,496 A * 4/1974 Stadmark ..... F28F 3/083 159/28.6
3,825,412 A 7/1974 Mullender
3,830,684 A 8/1974 Hamon
3,840,070 A * 10/1974 Becker ..... F25J 3/04 159/28.6
3,887,664 A 6/1975 Regehr
RE28,534 E 8/1975 Arne
3,901,309 A 8/1975 Thebert
3,910,344 A * 10/1975 Hagen ..... F28D 19/042 165/10
3,931,854 A * 1/1976 Ivakhnenko ..... F28D 9/0037 165/166
3,941,185 A 3/1976 Henning
3,952,077 A 4/1976 Wigley
3,963,810 A 6/1976 Holmberg et al.
4,034,135 A 7/1977 Passmore
4,049,855 A 9/1977 Cogan
4,061,183 A 12/1977 Davis
4,098,722 A 7/1978 Cairns et al.
4,144,369 A 3/1979 Wass
4,182,402 A 1/1980 Adrian
4,202,449 A 5/1980 Bendt
4,228,847 A 10/1980 Lindahl
4,296,050 A 10/1981 Meier
4,320,073 A 3/1982 Bugler, III et al.
4,337,287 A 6/1982 Falkenberg
4,343,355 A 8/1982 Goloff et al.
4,344,899 A 8/1982 Monjoie
4,361,426 A 11/1982 Carter et al.
4,374,542 A 2/1983 Bradley
4,396,058 A 8/1983 Kurschner et al.
4,409,274 A 10/1983 Chaplin et al.
4,423,772 A 1/1984 Dahlgren
4,449,573 A 5/1984 Pettersson et al.
4,472,473 A 9/1984 Davis et al.
4,501,318 A 2/1985 Herbrank
4,512,389 A 4/1985 Goetschius
4,518,544 A 5/1985 Carter et al.
4,553,458 A 11/1985 Schoonover
4,605,996 A 8/1986 Payne
4,633,936 A 1/1987 Nilsson
4,668,443 A 5/1987 Rye
4,676,934 A 6/1987 Seah
4,689,261 A 8/1987 Ahnstrom
4,744,410 A 5/1988 Groves
4,769,968 A 9/1988 Davis et al.
4,791,773 A 12/1988 Taylor
4,842,920 A 6/1989 Banai et al.
4,847,019 A 7/1989 McNab
4,857,370 A 8/1989 Overbergh et al.
4,862,666 A 9/1989 Kero
4,876,134 A 10/1989 Saitoh et al.
4,906,510 A 3/1990 Todor, Jr. et al.
4,915,165 A 4/1990 Dahlgren et al.
4,930,569 A 6/1990 Harder
4,950,430 A 8/1990 Chen et al.
4,953,629 A 9/1990 Karlsson et al.
4,974,656 A 12/1990 Judkins
4,981,732 A 1/1991 Hoberman
5,085,268 A 2/1992 Nilsson
5,203,832 A * 4/1993 Beatenbough ..... F28D 9/0012 165/167
5,308,677 A 5/1994 Renna
5,314,006 A 5/1994 Kaastra et al.
5,314,738 A 5/1994 Ichikawa
5,318,102 A 6/1994 Spokoyny et al.
5,380,579 A 1/1995 Bianchi
5,413,741 A 5/1995 Buchholz et al.
5,413,872 A 5/1995 Faigle
5,441,793 A 8/1995 Siiess
5,487,424 A * 1/1996 Davison ..... F28D 9/0037 165/166
5,489,463 A 2/1996 Paulson
H1621 H 12/1996 Ray
5,598,930 A 2/1997 Leone et al.
5,600,928 A 2/1997 Hess et al.
5,609,942 A 3/1997 Ray
5,647,741 A 7/1997 Bunya et al.
5,667,875 A 9/1997 Usui
5,747,140 A 5/1998 Heerklotz
5,792,539 A 8/1998 Hunter
5,803,158 A 9/1998 Harder et al.
5,836,379 A 11/1998 Counterman
5,899,261 A 5/1999 Brzytwa et al.
5,979,050 A * 11/1999 Counterman ..... B21D 13/04 165/10
6,019,160 A 2/2000 Chen
6,098,706 A * 8/2000 Urch ..... F28D 9/0025 165/153
6,145,582 A 11/2000 Bolle et al.
6,251,499 B1 6/2001 Lehman et al.
6,280,824 B1 8/2001 Insley et al.
6,280,856 B1 8/2001 Andersen et al.
6,497,130 B2 12/2002 Nilsson
6,516,871 B1 * 2/2003 Brown ..... F28D 19/044 165/10
6,544,628 B1 4/2003 Aull et al.
6,660,402 B2 12/2003 Tanabe
6,764,532 B1 7/2004 Cheng
7,555,891 B2 7/2009 Muller et al.
7,938,627 B2 5/2011 Muller
8,296,946 B2 10/2012 Wieres et al.
8,323,778 B2 12/2012 Webb et al.
8,590,606 B2 * 11/2013 Arai ..... F24F 12/006 165/166
9,200,853 B2 * 12/2015 O'Boyle ..... F28D 19/042
9,359,952 B2 * 6/2016 Menheere ..... F02C 7/10
2002/0043362 A1 4/2002 Wilson
2003/0178173 A1 * 9/2003 Harting ..... F23L 15/02 165/8
2005/0274012 A1 12/2005 Hodgson et al.
2010/0218927 A1 * 9/2010 Cooper ..... F28F 3/046 165/185
2010/0258284 A1 10/2010 Krantz
2013/0153184 A1 * 6/2013 Rolt ..... F28F 3/046 165/166
2013/0180699 A1 * 7/2013 Dahlberg ..... F28D 9/0031 165/185
2013/0209322 A1 * 8/2013 Gaiser ..... F01N 3/2814 422/175

* cited by examiner

HEAT TRANSFER ELEMENT FOR A ROTARY REGENERATIVE HEAT EXCHANGER

This is a divisional application claiming priority to pending application Ser. No. 12/543,648 having a filing date of Aug. 19, 2009, incorporated herein in its entirety by reference.

BACKGROUND

The present invention relates to heat transfer elements of the type found in rotary regenerative heat exchangers.

Rotary regenerative heat exchangers are commonly used to transfer heat from flue gases exiting a furnace to the incoming combustion air. Conventional rotary regenerative heat exchangers, such as that shown as 1 in FIG. 1, have a rotor 12 mounted in a housing 14. The housing 14 defines a flue gas inlet duct 20 and a flue gas outlet duct 22 for the flow of heated flue gases 36 through the heat exchanger 1. The housing 14 further defines an air inlet duct 24 and an air outlet duct 26 for the flow of combustion air 38 through the heat exchanger 1. The rotor 12 has radial partitions 16 or diaphragms defining compartments 17 therebetween for supporting baskets (frames) 40 of heat transfer elements. The rotary regenerative heat exchanger 1 is divided into an air sector and a flue gas sector by sector plates 28, which extend across the housing 14 adjacent the upper and lower faces of the rotor 12.

FIG. 2 depicts an end elevation view of an example of an element basket 40 including a few elements 10 stacked therein. While only a few elements 10 are shown, it will be appreciated that the basket 40 will typically be filled with elements 10. As can be seen in FIG. 2, the elements 10 are closely stacked in spaced relationship within the element basket 40 to form passageways 70 between the elements 10 for the flow of air or flue gas.

Referring to FIGS. 1 and 2, the hot flue gas stream 36 is directed through the gas sector of the heat exchanger 1 and transfers heat to the elements 10 on the continuously rotating rotor 12. The elements 10 are then rotated about axis 18 to the air sector of the heat exchanger 1, where the combustion air stream 38 is directed over the elements 10 and is thereby heated. In other forms of rotary regenerative heat exchangers, the elements 10 are stationary and the air and gas inlet and outlet portions of the housing 14 rotate.

FIG. 3 depicts portions of conventional elements 10 in stacked relationship, and FIG. 4 depicts a cross-section of one of the conventional elements 10. Typically, elements 10 are steel sheets that have been shaped to include one or more various notches 50 and undulations 65.

Notches 50, which extend outwardly from the element 10 at generally equally spaced intervals, maintain spacing between adjacent elements 10 when the elements 10 are stacked as shown in FIG. 3, and thus form sides of the passageways 70 for the air or flue gas between the elements 10. Typically, the notches 50 extend at a predetermined angle (e.g. 90 degrees) relative to the fluid flow through the rotor (12 of FIG. 1).

In addition to the notches 50, the element 10 is typically corrugated to provide a series of undulations (corrugations) 65 extending between adjacent notches 50 at an acute angle Au to the flow of heat exchange fluid, indicated by the arrow marked "A" in FIG. 3. The undulations 65 have a height of Hu and act to increase turbulence in the air or flue gas flowing through the passageways 70 and thereby disrupt the thermal boundary layer that would otherwise exist in that part of the fluid medium (either air or flue gas) adjacent to the surface of the element 10. The existence of an undisrupted fluid boundary layer tends to impede heat transfer between the fluid and the element 10. The undulations 65 on adjacent elements 10 extend obliquely to the line of flow. In this manner, the undulations 65 improve heat transfer between the element 10 and the fluid medium. Furthermore, the elements 10 may include flat portions (not shown), which are parallel to and in full contact with the notches 50 of adjacent elements 10. For examples of other heat transfer elements 10, reference is made to U.S. Pat. Nos. 2,596,642; 2,940,736; 4,396,058; 4,744,410; 4,553,458; and 5,836,379.

Although such elements exhibit favorable heat transfer rates, the results can vary rather widely depending upon the specific design and the dimensional relationship between the notches and the undulations. For example, while the undulations provide an enhanced degree of heat transfer, they also increase the pressure drop across the heat exchanger (1 of FIG. 1). Ideally, the undulations on the elements will induce a relatively high degree of turbulent flow in that part of the fluid medium adjacent to the elements, while the notches will be sized so that the fluid medium that is not adjacent to the elements (i.e., the fluid near the center of the passageways) will experience a lesser degree of turbulence, and therefore much less resistance to flow. However, attaining the optimum level of turbulence from the undulations can be difficult to achieve since both the heat transfer and the pressure loss tend to be proportional to the degree of turbulence that is produced by the undulations. An undulation design that raises the heat transfer tends to also raise the pressure loss and, conversely, a shape that lowers the pressure loss tends to lower the heat transfer as well.

Design of the elements must also present a surface configuration that is readily cleanable. To clean the elements, it has been customary to provide soot blowers that deliver a blast of high-pressure air or steam through the passages between the stacked elements to dislodge any particulate deposits from the surface thereof and carry them away leaving a relatively clean surface. To accommodate soot blowing, it is advantageous for the elements to be shaped such that when stacked in a basket the passageways are sufficiently open to provide a line of sight between the elements, which allows the soot blower jet to penetrate between the sheets for cleaning. Some elements do not provide for such an open channel, and although they have good heat transfer and pressure drop characteristics, they are not very well cleaned by conventional soot blowers. Such open channels also allow for the operation of a sensor for measuring the quantity of infrared radiation leaving the element. Infrared radiation sensors can be used to detect the presence of a "hot spot", which is generally recognized as a precursor to a fire in the basket (40 of FIG. 2). Such sensors, commonly known as "hot spot" detectors, are useful in preventing the onset and growth of fires. Elements that do not have an open channel prevent infrared radiation from leaving the element and from being detected by the hot spot detector.

Thus, there is a need for a rotary regenerative heat exchanger heat transfer element that provides decreased pressure loss for a given amount of heat transfer and that is readily cleanable by a soot blower and compatible with a hot spot detector.

SUMMARY OF THE INVENTION

The present invention may be embodied as a heat transfer element [100] for a rotary regenerative heat exchanger [1] including:

notches [150] extending parallel to each other and configured to form passageways [170] between adjacent heat transfer elements [100], each of the notches [150] including lobes [151] projecting outwardly from opposite sides of the heat transfer element [100] and having a peak-to-peak height Hn;

first undulations [165] extending parallel to each other between the notches [150], each of the first undulations [165] including lobes [161] projecting outwardly from the opposite sides of the heat transfer element [100] having a peak-to-peak height Hu1; and second undulations [185] extending parallel to each other between the notches [150], each of the second undulations [185] including lobes [181] projecting outwardly from the opposite sides of the heat transfer element [100] having a peak-to-peak height Hu2, wherein Hu2 is less than Hu1.

It may also be embodied as a heat transfer element [100] for a rotary regenerative heat exchanger [1] including:

notches [150] extending parallel to each other and configured to form passageways [170] between adjacent heat transfer elements [100], each of the notches [150] including lobes [151] projecting outwardly from opposite sides of the heat transfer element [100];

first undulations [165] disposed between the notches [150], the first undulations [165] extending parallel to each other and having a width Wu1;

second undulations [185] disposed between the notches [150], the second undulations [185] extending parallel to each other and having a width Wu2, wherein Wu1 is not equal to Wu2.

The present invention may also be embodied as a basket [40] for a rotary regenerative heat exchanger [1] including:

a plurality of heat transfer elements [100] stacked in spaced relationship thereby providing a plurality of passageways [170] between adjacent heat transfer elements [100] for flowing a heat exchange fluid therebetween, each of the heat transfer elements [100] including:

notches [150] extending parallel to each other and configured to form passageways [170] between adjacent heat transfer elements [100], each of the notches [150] including lobes [151] projecting outwardly from opposite sides of the heat transfer element [100] and having a peak-to-peak height Hn;

first undulations [165] extending parallel to each other between the notches [150], each of the first undulations [165] including lobes [161] projecting outwardly from the opposite sides of the heat transfer element [100] having a peak-to-peak height Hu1; and second undulations [185] extending parallel to each other between the notches [150], each of the second undulations [185] including lobes [181] projecting outwardly from the opposite sides of the heat transfer element [100] having a peak-to-peak height Hu2, wherein Hu2 is less than Hu1, and Hu1 is less than Hn.

BRIEF DESCRIPTION OF THE DRAWINGS

The subject matter regarded as the invention is particularly pointed out and distinctly claimed in the claims at the conclusion of the specification. The foregoing and other features and advantages of the invention are apparent from the following detailed description taken in conjunction with the accompanying drawings in which:

DESCRIPTION OF THE PREFERRED EMBODIMENT

Figure 1:
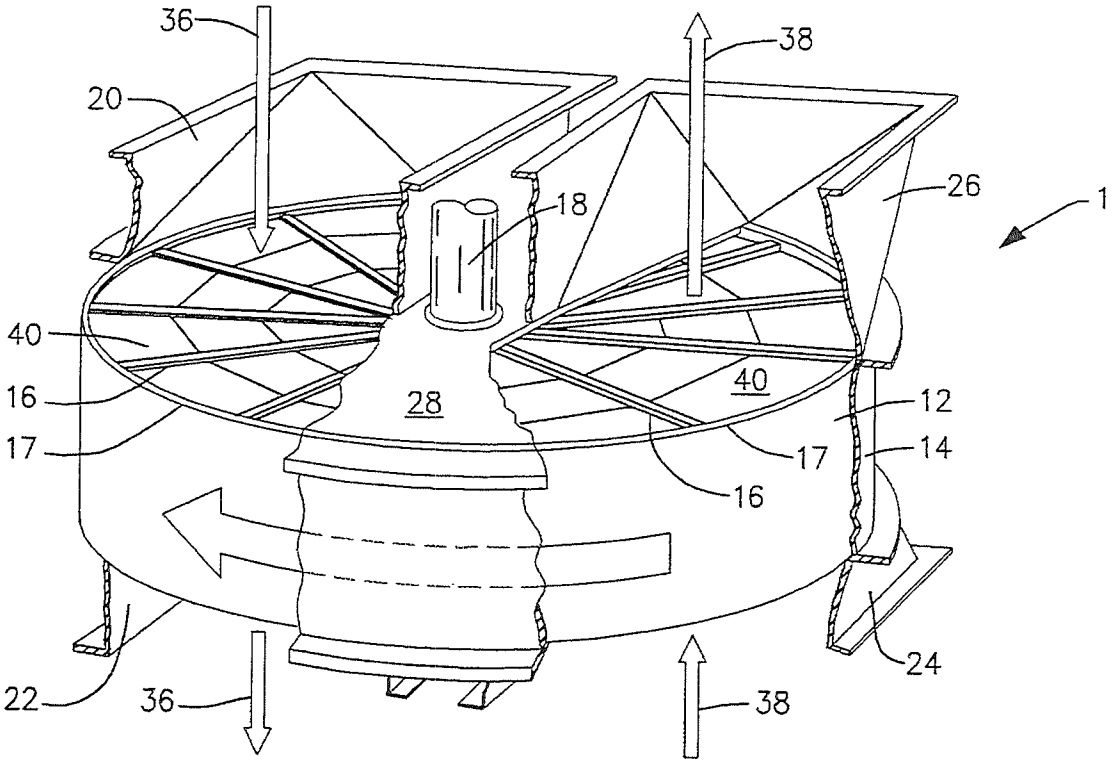
Figure 1 PRIOR ART
FIG. 1 is a partially broken away perspective view of a prior art rotary regenerative heat exchanger.
Figure 2:
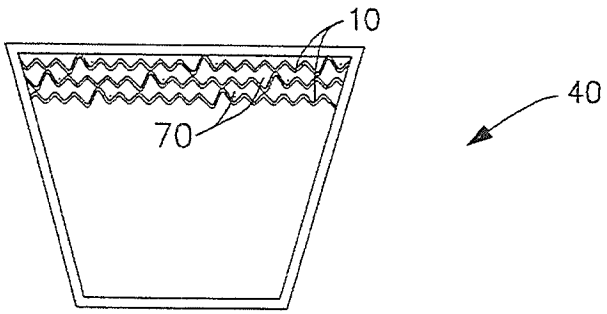
Figure 2 PRIOR ART
FIG. 2 is a top plan view of a prior art element basket including a few heat transfer elements.
Figure 3:
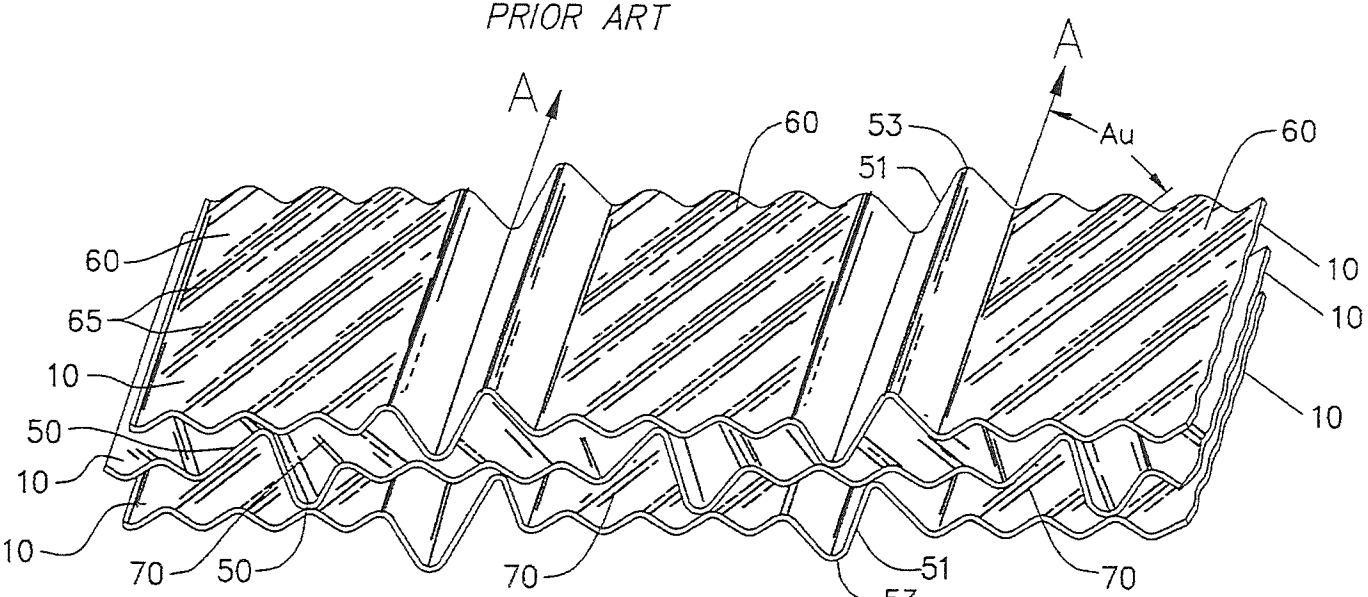
Figure 3 PRIOR ART
FIG. 3 is a perspective view of a portion of three prior art heat transfer elements in stacked configuration.
Figure 5:
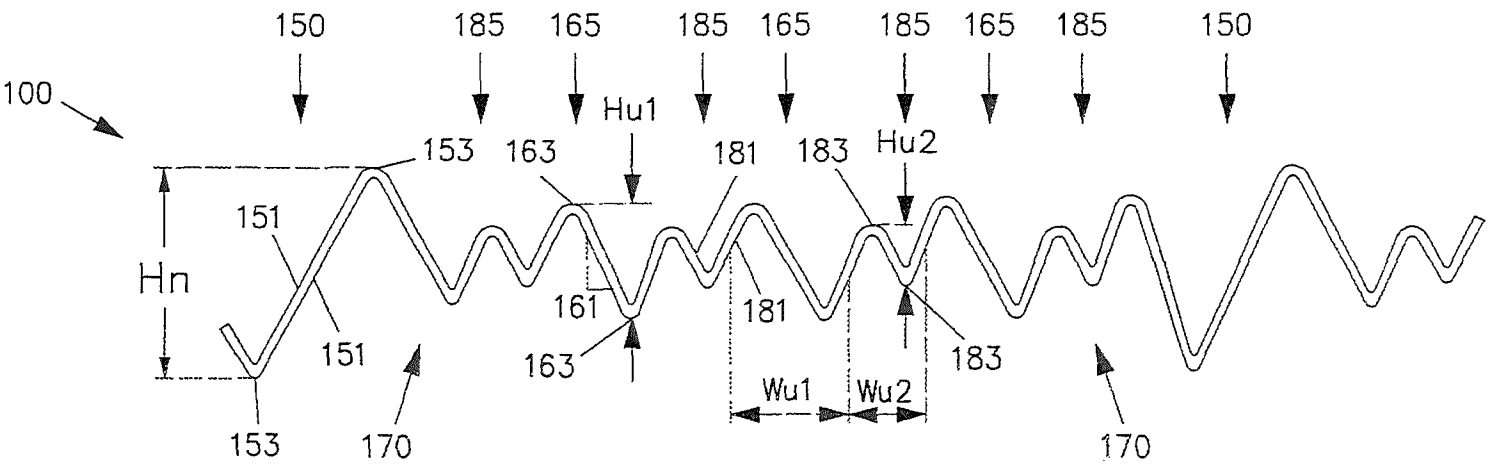
FIG. 5 is a cross-sectional elevation view of a heat transfer element in accordance with an embodiment of the present invention.
Figure 6:
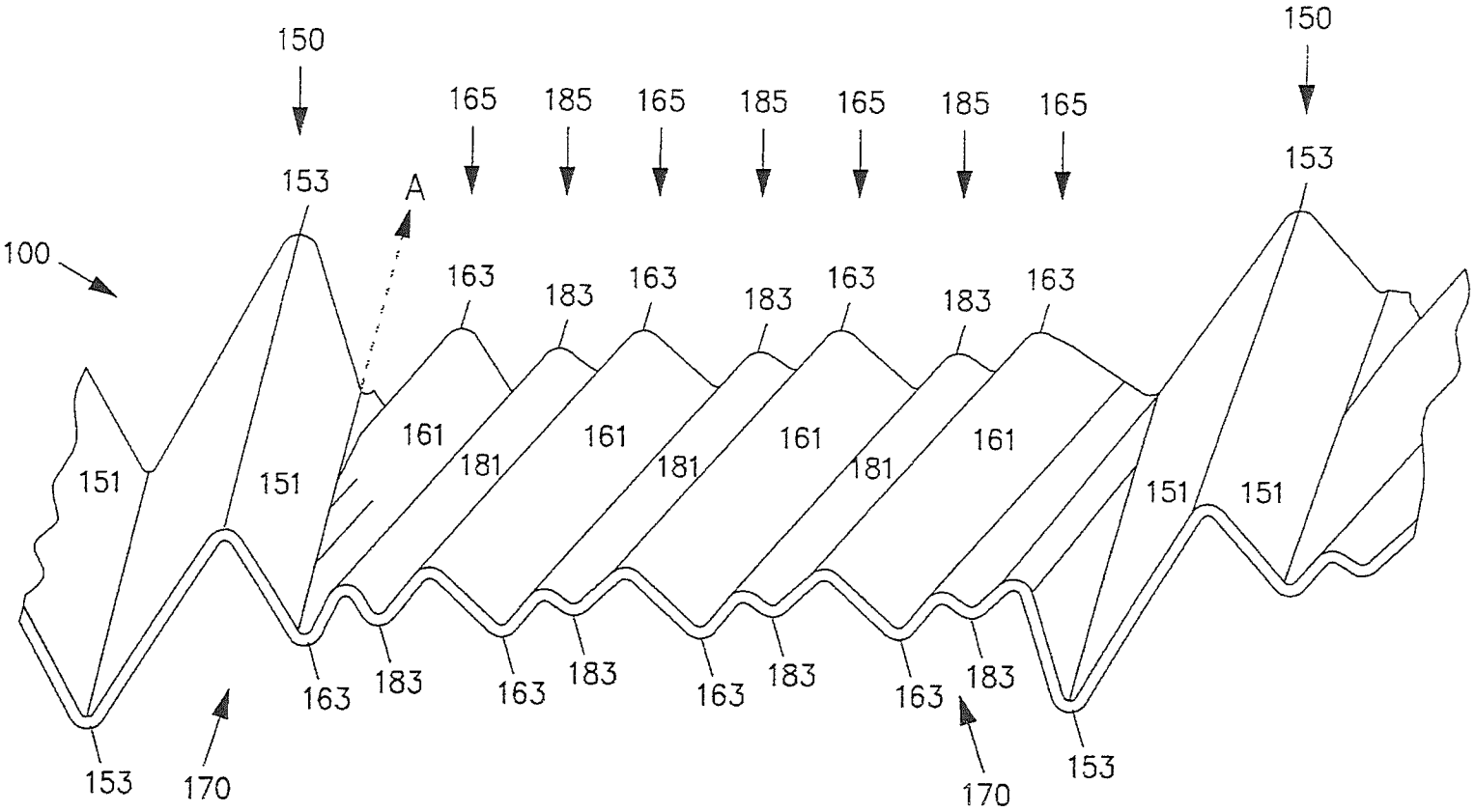
FIG. 6 is a perspective view of a portion of a heat transfer element in accordance with the embodiment of the present invention.

FIGS. 5 and 6 depict a portion of a heat transfer element 100 in accordance with an embodiment of the present invention. The element 100 may be used in place of conventional elements 10 in a rotary regenerative heat exchanger (1 of FIG. 1). For example, elements 100 may be stacked as shown in FIG. 3 and inserted in a basket 40 as depicted in FIG. 2 for use in the rotary regenerative heat exchanger 1 of the type depicted in FIG. 1.

The invention will be described in connection with reference to both FIGS. 5 and 6. The element 100 is formed from thin sheet metal capable of being rolled or stamped to the desired configuration. Element 100 has a series of notches 150 at spaced intervals which extend longitudinally and approximately parallel to the direction of flow of the heat exchange fluid past element 100 as indicated by the arrow labeled "A". These notches 150 maintain adjacent elements 100 a predetermined distance apart and form the flow passages 170 between the adjacent elements 100 when the elements 100 are stacked. Each notch 150 comprises one lobe 151 projecting outwardly from the surface of the element 100 on one side and another lobe 151 projecting outwardly from the surface of the element 100 on the opposite side. Each lobe 151 may be in the form of a U-shaped groove with the peaks 153 of the notches 150 directed outwardly from the element 100 in opposite directions. The peaks 153 of the notches 150 contact the adjacent elements 100 to maintain the element 100 spacing. As also noted, the elements 100 may be arranged such that the notches 150 on one element 100 are located about mid-way between the notches 150 on the adjacent elements 100 for maximum support. Although not shown, it is contemplated that the element 100 may include a flat region that extends parallel to the notches 150, upon which the notch 150 of an adjacent element 100 rests. The peak-to-peak height between the lobes 151 for each notch 150, is designated Hn.

Disposed on the element 100 between the notches 150 are undulation (corrugation) 165, 185 having two different heights. Each of these comprises a plurality of undulations 165, 185, respectively. While only a portion of the element 100 is shown, it will be appreciated that an element 100 may include several notches 150 with undulations 165 and 185 disposed between each pair of notches 150.

Each undulation 165 extends parallel to the other undulations 165 between the notches 150. Each undulation 165 includes one lobe 161 projecting outwardly from the surface of the element 100 on one side and another lobe 161 projecting outwardly from the surface of the element 100 on the opposite side. Each lobe 161 may be in the form of a U-shaped channel with the peaks 163 of the channels directed outwardly from the element 100 in opposite directions. Each of the undulations 165 has a peak-to-peak height Hu1 between the peaks 163.

Each undulation 185 extends parallel to the other undulations 185 between the notches 150. Each undulation 185 includes one lobe 181 projecting outwardly from the surface of the element 100 on one side and another lobe 181 projecting outwardly from the surface of the element 100 on the opposite side. Each lobe 181 may be in the form of a U-shaped channel having peaks 183 of the channels directed outwardly from the element 100 in opposite directions. Each of the undulations 185 has a peak-to-peak height Hu2 between the peaks 183.

In one aspect of the present invention, Hu1 and Hu2 are of different heights. The ratio of Hu1/Hn is a critical parameter because it defines the height of the open area between adjacent elements 100 forming passageways 170 for the fluid to flow through.

In the embodiment shown, Hu2 is less than Hu1, and both Hu1 and Hu2 are less than Hn. Preferably, the ratio of Hu2/Hu1 is greater than about 0.20 and less than about 0.80; and more preferably the ratio of Hu2/Hu1 is greater than about 0.35 and less than about 0.65. The ratio of Hu2/Hn is preferably greater than about 0.06 and less than about 0.72, and the ratio of Hu1/Hn is preferably greater than about 0.30 and less than about 0.90. When the Hu2/Hu1 ratio drops below 0.20, the smaller undulations have less effect on creating turbulence, and are less effective.

When the Hu2/Hu1 ratio is above 0.80, the two undulation heights are nearly equal and there is minimal improvement over prior art.

Once the Hu1/Hn ratio and the Hu2/Hu1 ratios have been chosen, the Hu2/Hn ratio is fixed.

In another aspect of the present invention, the individual width of each of the undulations 165 may be different than the individual width of each of the undulations 185, as indicated by Wu1 and Wu2. Preferably, the ratio Wu2/Wu1 is greater than 0.20 and less than 1.20; and more preferably, Wu2/Wu1 is greater than 0.50 and less than 1.10. The selection of the Wu1 and Wu2 are, to a great degree, dependent on the values used for Hu1 and Hu2. One of the overall objectives of the preferred embodiment of the present invention is to create an optimal amount of turbulence near the surface of the elements. This means that the shapes, as viewed in cross-section, of both types of undulations need to be designed in accordance with that goal, and the shape of each undulation is determined largely by the ratio of its height to its width. In addition, the choice of the undulation widths can also affect the quantity of surface area provided by the elements, and surface area also has an impact on the amount of heat transfer between the fluid and the elements.

Figure 4:
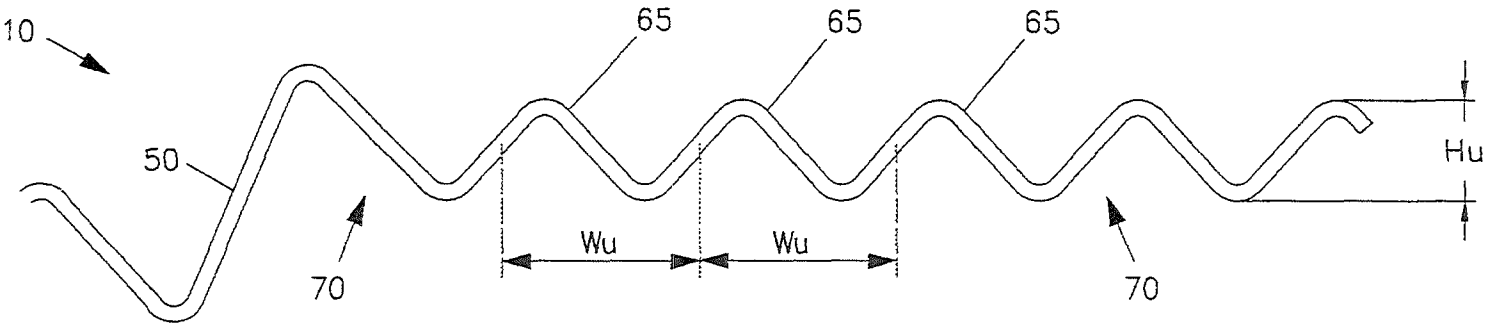
Figure 4 PRIOR ART
FIG. 4 is a cross-sectional elevation view of a prior art heat transfer element.

In contrast, as shown in FIG. 4, the undulations 65 in conventional elements 10 are all of the same height, Hu, and are all of the same width, Wu. Wind tunnel tests have surprisingly shown that replacing the conventional, uniform undulations 65 with the undulations 165 and 185 of the present invention can reduce the pressure loss significantly (about 14%) while maintaining the same rate of heat transfer and fluid flow. This translates to a cost savings to the operator because reducing the pressure loss of the air and the flue gas as they flow through the rotary regenerative heat exchanger will reduce the electrical power consumed by the fans that are used to force the air and the flue gas to flow through the heat exchanger.

While not wanting to be bound by theory, it is believed that the difference in height and/or width between undulations 165 and 185 encountered by the heat transfer medium as it flows between the elements 100 creates more turbulence in the fluid boundary layer adjacent to the surface of the elements 100, and less turbulence in the open section of the passageways 170 that are farther away from the surface of the elements 100. The added turbulence in the boundary layer increases the rate of heat transfer between the fluid and the elements 100. The reduced turbulence away from the surface of the elements 100, serves to reduce the pressure loss as the fluid flows through the passageways 170. By adjusting the two undulation heights, Hu1 and Hu2, it is possible to reduce the fluid pressure loss for the same amount of total heat transferred.

The superior heat transfer and pressure drop performance of the element 100 of the present invention also has the advantage that the angle between the undulations 165 and the primary flow direction of the heat transfer fluid can be reduced somewhat, while still maintaining an equal amount of heat transfer when compared to elements 10 having conventional, uniform undulations 65. This is also true of the angle between the undulations 185 and the primary flow direction of the heat transfer fluid.

This allows for better cleaning by a soot blower jet since the undulations 165 and 185 are better aligned with the jet. Furthermore, because a decreased undulation angle provides a better line-of sight between the elements 100, the present invention is compatible with an infrared radiation (hot spot) detector.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat transfer element for a rotary regenerative heat exchanger comprising:

notches extending parallel to each other and configured to form passageways between adjacent heat transfer elements upon stacking thereof, each of the notches including lobes projecting outwardly from opposite sides of the heat transfer element;

first undulations disposed between the notches, the first undulations extending parallel to each other, each first undulation having a width Wu1; and, second undulations disposed between the notches, and adjacent to and alternating with the first undulations, the second undulations extending parallel to each other, each second undulation having a width Wu2, wherein the width Wu1 is not equal to the width Wu2.

2. The heat transfer element of claim 1, wherein the ratio of the width Wu2 to the width Wu1 is greater than 0.2 and less than 1.2.

3. The heat transfer element of claim 1, wherein the ratio of the width Wu2 to the width Wu1 is greater than 0.5 and less than 1.1.

* * * * *